US009585467B2

(12) United States Patent
Leng

(10) Patent No.: US 9,585,467 B2
(45) Date of Patent: Mar. 7, 2017

(54) LIFTING DESK

(71) Applicant: NEW-TEC INTEGRATION (XIAMEN) CO., LTD., Xiamen, Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 14/919,170

(22) Filed: Oct. 21, 2015

(65) Prior Publication Data

US 2016/0135589 A1 May 19, 2016

(30) Foreign Application Priority Data

Nov. 19, 2014 (CN) ..... 2014 2 0698678 U

(51) Int. Cl.

| | |
|---|---|
| ***A47F 5/12*** | (2006.01) |
| ***A47B 21/02*** | (2006.01) |
| ***A47B 9/14*** | (2006.01) |
| ***A47B 9/20*** | (2006.01) |
| ***A47B 13/00*** | (2006.01) |
| ***A47B 3/08*** | (2006.01) |

(52) U.S. Cl.

CPC ..... *A47B 21/02* (2013.01); *A47B 3/08* (2013.01); *A47B 9/14* (2013.01); *A47B 9/20* (2013.01); *A47B 13/003* (2013.01)

(58) Field of Classification Search

CPC .... A47B 2200/0042; A47B 2200/0043; A47B 21/02; A47B 3/002; A47B 9/14; A47B 13/003

USPC ..... 108/9, 10, 117, 116, 115; 248/434, 165, 248/166, 157, 188.6

See application file for complete search history.

(56) References Cited

U.S. PATENT DOCUMENTS

| | | | | | |
|---|---|---|---|---|---|
| 355,911 | A * | 1/1887 | Bartow, Jr. | A47B 27/02 | 108/10 |
| 1,232,757 | A * | 7/1917 | Berkey | A47B 9/16 | 108/116 |
| 1,653,657 | A * | 12/1927 | Pretsch | A47B 23/046 | 108/141 |
| 1,915,802 | A * | 6/1933 | Roshnell | F16M 11/42 | 108/10 |
| RE25,376 | E * | 4/1963 | Freeman | A47B 1/04 | 108/10 |
| 4,248,161 | A * | 2/1981 | Adair | A47B 27/02 | 108/6 |

(Continued)

*Primary Examiner* — Jose V Chen

(74) *Attorney, Agent, or Firm* — Rabin & Berdo, P.C.

(57) ABSTRACT

A lifting desk includes a desk top, a support frame and a base. The support frame has an inner pipe with a top end, a bottom end, and an outer pipe. The inner pipe is movably inserted into the outer pipe, the top end of the inner pipe pivotally joining the desk top, the bottom end of the outer pipe pivotally joining the base; a connecting bar and a drawing bar, one end of the connecting bar pivotally joining the center position of the inner pipe, the other end slidably connected to the bottom surface of the desk top, one end of the drawing bar pivotally joining the base, the other end of the drawing bar slidably connected to the outer pipe. The desk top, the inner pipe and the connecting bar form a link mechanism. The outer pipe, the base and the drawing bar form a second link mechanism.

10 Claims, 8 Drawing Sheets

(56) References Cited

U.S. PATENT DOCUMENTS

| | | | | | |
|---|---|---|---|---|---|
| 4,938,153 | A * | 7/1990 | Maes | A47B 23/046 | 108/128 |
| 5,144,898 | A * | 9/1992 | Posly | A47B 23/046 | 108/148 |
| 6,688,634 | B2 * | 2/2004 | Noffsinger | B25H 3/06 | 280/47.19 |
| 6,920,834 | B1 * | 7/2005 | Pehta | A47B 9/14 | 108/147.21 |
| 7,631,604 | B2 * | 12/2009 | Huang | A47B 3/08 | 108/115 |
| 8,960,104 | B2 * | 2/2015 | Copeland | A47B 3/00 | 108/117 |
| 9,149,111 | B1 * | 10/2015 | Lin | A47B 3/0812 | |
| 2005/0183641 | A1 * | 8/2005 | Suzuki | A47C 4/20 | 108/129 |
| 2007/0234934 | A1 * | 10/2007 | Branch | A47B 23/046 | 108/115 |
| 2009/0241805 | A1 * | 10/2009 | Hernandez | A47B 3/0815 | 108/6 |
| 2014/0060393 | A1 * | 3/2014 | Fan | F16M 11/14 | 108/3 |

* cited by examiner

LIFTING DESK

FIELD OF THE INVENTION

The present invention relates to a lifting desk, specifically, the present invention relates to a foldable lifting desk.

BACKGROUND OF THE INVENTION

The height of a lifting desk can be adjusted as needed to meet the needs according to the different users' heights. However, the lifting desk, in addition to the desk top, also has a support frame to support the desk top and support legs to ensure the stable standing of the support frame. The desk top and the support legs are disposed at the top and bottom ends of the support frame. The desk occupies a large space and is inconvenient to store, move and transport, and particularly inconvenient to load into a container.

SUMMARY OF THE INVENTION

The present invention provides a foldable lifting desk that overcomes the disadvantages of the existing technology. The technical solution of the present invention provides:

A lifting desk comprising a desk top, a base, and a support frame, the support frame comprising: an inner pipe and an outer pipe, the inner pipe having a top end and a bottom end, the inner pipe movably inserted into the outer pipe, the top end of the inner pipe pivotally joining the desk top, the bottom end of the outer pipe pivotally joining the base; a connecting bar and a drawing bar, one end of the connecting bar pivotally joining the center position of the inner pipe, the other end of the connecting bar slidably connected to the bottom surface of the desk top, one end of the drawing bar pivotally joining the base, the other end of the drawing bar slidably connected to the outer pipe.

Preferably, the support frame further comprises a slide bar, the slide bar is connected to the bottom portion of the desk top, the connecting bar is slidably connected to the slide bar.

Preferably, the slide bar is disposed with a plurality of position holes along the longitudinal direction, the support frame further comprises a control module, the control module comprises a slide sleeve, a switch and a position pin, the connecting bar pivotally joins the slide sleeve, the slide sleeve is sleeved on the slide bar, a central portion of the switch pivotally joins the slide sleeve, the position pin is connected to one end of the switch and is adapted to be inserted into a position hole.

Preferably, the inner pipe is situated near one end of the slide bar.

Preferably, the lifting desk further comprises two connecting bars pivotally joining the left and right side of the inner pipe.

Preferably, the support frame further comprises a slide set, the slide set is slidably connected to the outer pipe, the drawing bar pivotally joins the slide set.

Preferably, the slide set is disposed with a through hole, an elastic button is disposed in the outer pipe, the elastic button is adapted to extend out of the outer pipe and to embed into the through hole.

Preferably, the base is a U shaped pipe.

Preferably, when the slide set moves to the top portion of the outer pipe, the base is almost parallel to the outer pipe; and wherein the outer pipe is disposed with a position column, when the slide set moves downwardly to contact to the position column, the base is almost vertical to the outer pipe.

Preferably, the outer pipe is disposed with a plurality of fixing holes along the longitudinal direction, the inner pipe is disposed with an elastic button, the elastic button is adapted to extend out of the inner pipe and to embed into the fixing hole to lock the inner pipe.

Compared to the existing technology, the technical solution has following advantages:

The top end of the inner pipe pivotally joins the desk top. One end of the connecting bar joins pivotally to the center portion of the inner pipe, the other end of the connecting bar is slidably connected to the bottom surface of the desk top, so that the desk top, the inner pipe and the connecting bar form a linking mechanism. The desk top is therefore foldable, thus reducing the overall size of the lifting desk. The desk top also can be folded to be incline based on the user's preference. The bottom end of the outer pipe and one end of the drawing bar pivotally joint the base, the other end of the drawing bar is slidably connected to the outer pipe. The outer pipe, the base and the drawing bar form a second linking mechanism. The base is thus foldable, reducing the entire size of the lifting desk.

The slide bar is connected to the bottom portion of the desk top, so that it enhances the strength of the desk top, the connecting bar is slidably connected to the slide bar, so that it is convenient to slide and operate.

BELIEF DESCRIPTION OF THE DRAWINGS

The present invention will be further described with the drawings and the embodiments.

DETAILED DESCRIPTION OF THE EMBODIMENTS

Figure 1:
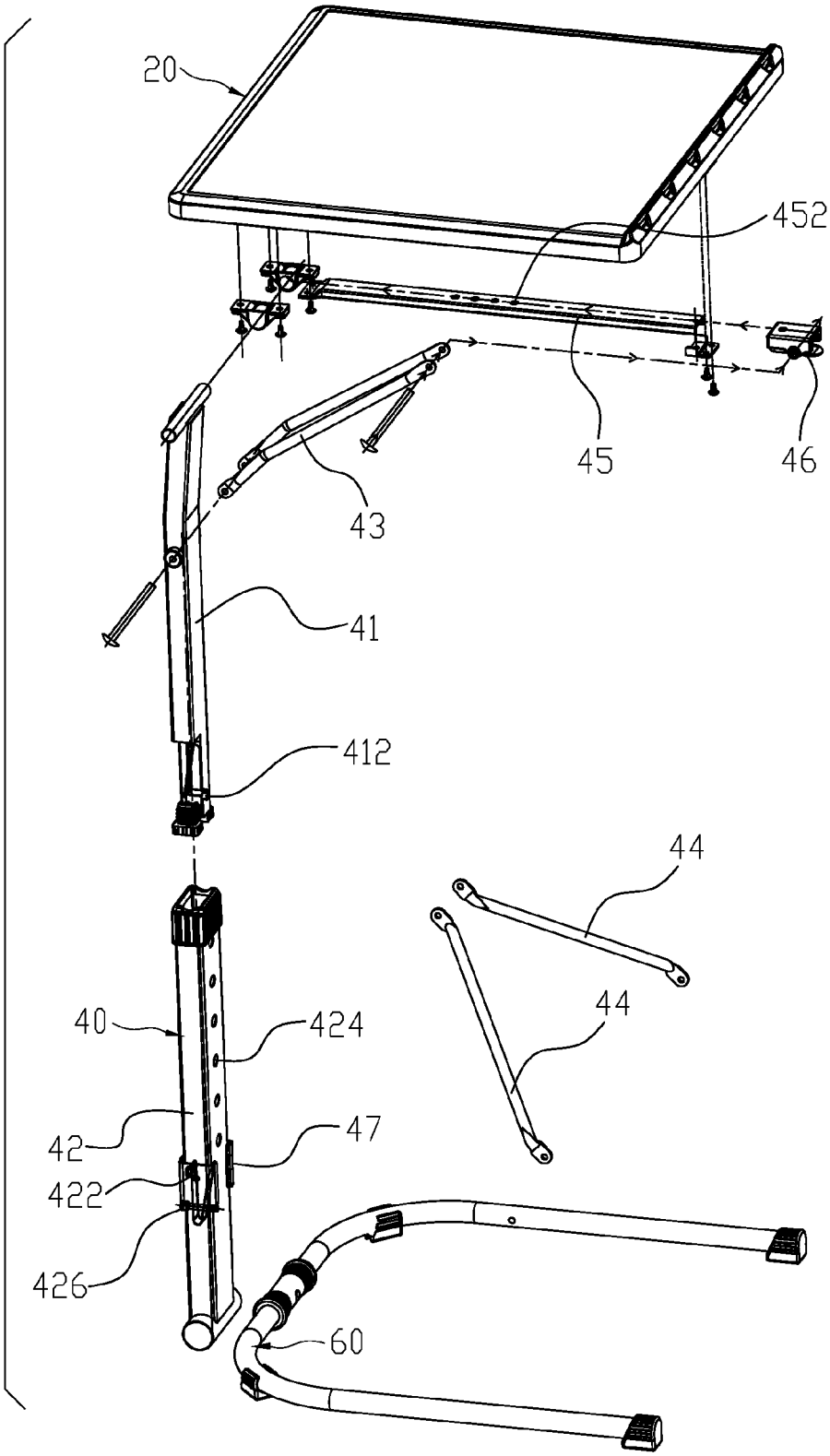
FIG. 1 is an exploded perspective view of a lifting desk in accordance with one embodiment of the present invention.

Referring to FIG. 1, a lifting desk according to one embodiment of the present invention comprises a desk top 20, a support frame 40 and a base 60. The base 60 is a U-shaped pipe.

The support frame 40 comprises an inner pipe 41, an outer pipe 42, two connecting bars 43, two drawing bars 44, a slide bar 45, a control module 46 and a slide set 47. The slide bar 45 is connected to the bottom portion of the desk top 20, the central portion of the slide bar 45 is disposed with a plurality of position holes 452 along the longitudinal direction.

Figure 3:
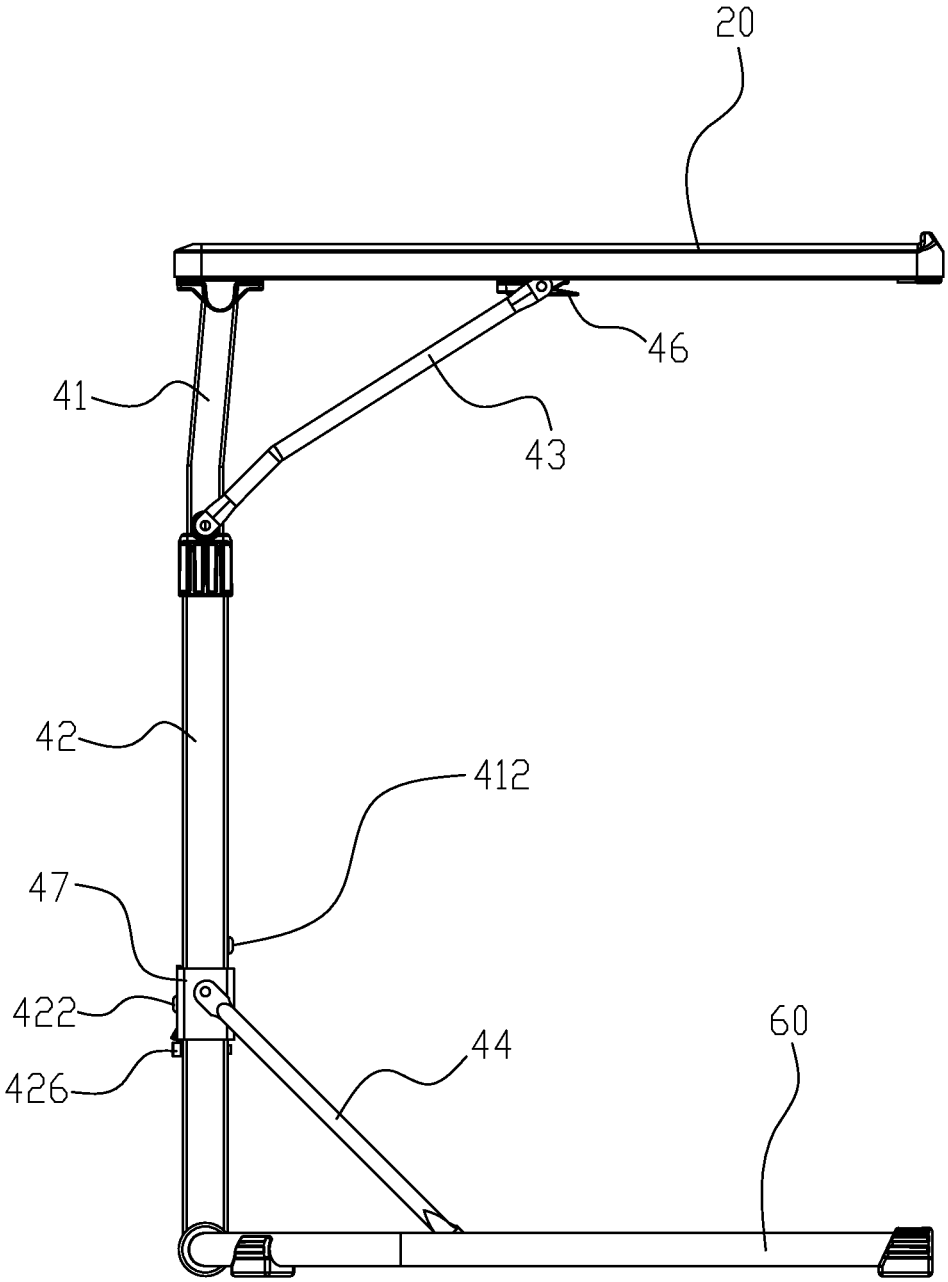
FIG. 3 is a side view of the lifting desk in accordance with one embodiment of the present invention.
Figure 5:
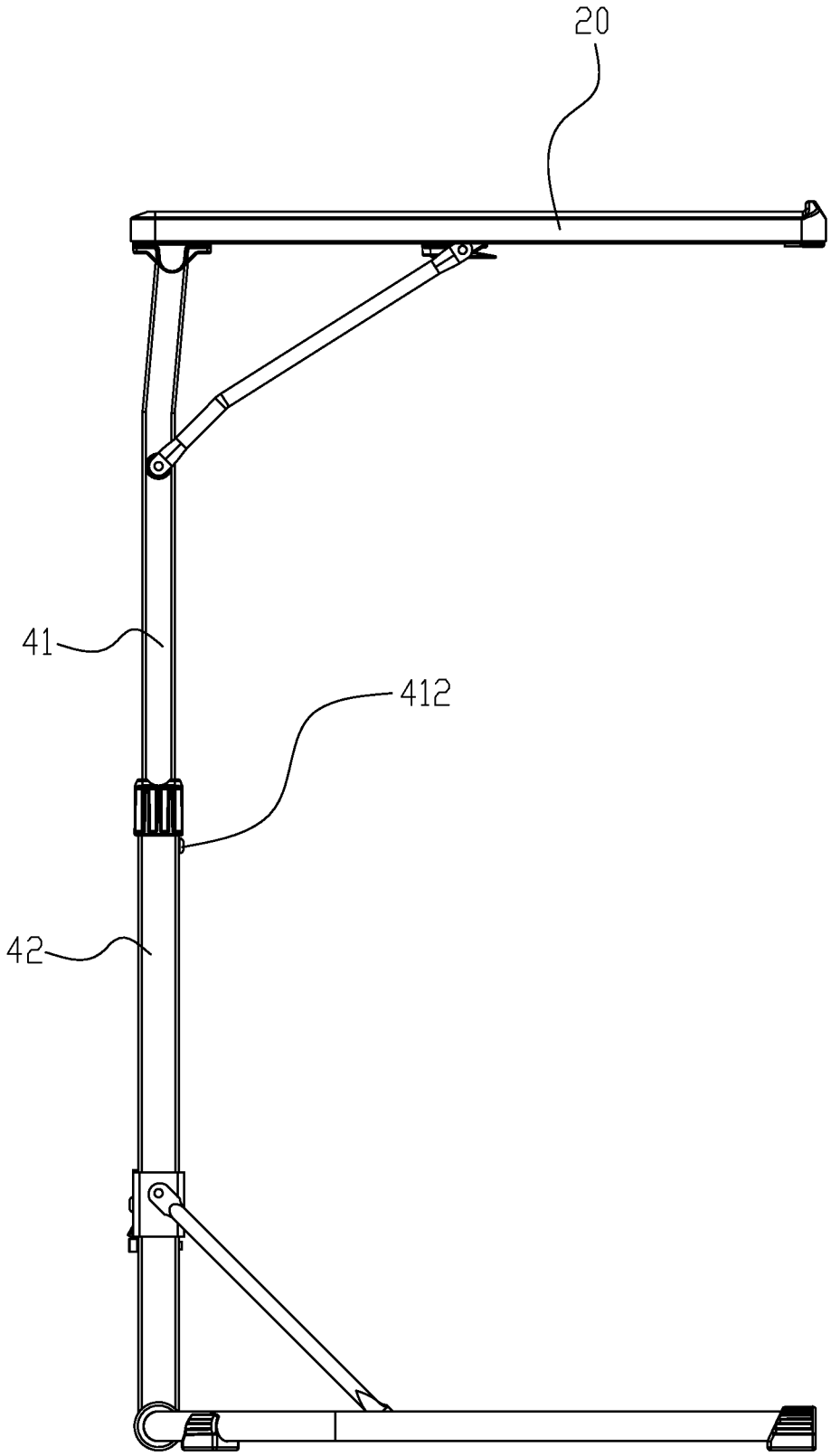
FIG. 5 is a side view of the lifting desk of FIG. 3 after the desk top being lifted.

The inner pipe 41 is movably inserted into the outer pipe 42. The top end of the inner pipe 41 pivotally joins the desk top 20, the inner pipe 41 is situated near the slide bar 45. The bottom end of the outer pipe 42 pivotally joins the middle portion of the base 60. An elastic button 422 is also disposed in the inner pipe 41, the elastic button 412 extends out of the inner pipe 41. An elastic button 422 is disposed in the outer pipe 42, the elastic button 422 extends out of the outer pipe 42. The upper portion of the outer pipe 42 is disposed with a plurality of fixing holes 424 along the longitudinal direction. The lower portion of the outer pipe 42 is disposed with a position column 426. The elastic button 412 extends out of the inner pipe 41 and is embedded to the fixing hole 424 to lock the inner pipe 41. When the elastic button 412 is pressed into the inner pipe 41, the lock to the inner pipe 41 is released, so that the inner pipe 41 is movable vertically to adjust the height of the desk 20 (referring to FIG. 3 and FIG. 5).

Two connecting bars 43 are respectively disposed at the left and right side of the inner pipe 41, one end of each connecting bar 43 pivotally joins the center position of the inner pipe.

Figure 2:
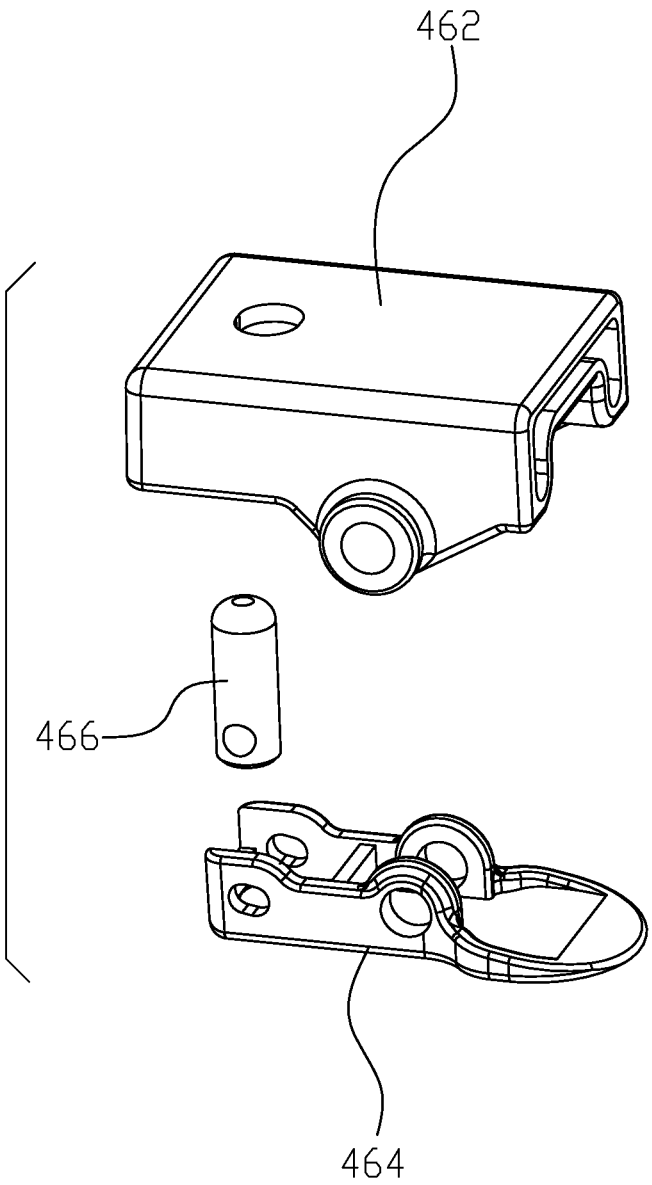
FIG. 2 is an exploded perspective view of a control module of the lifting desk of FIG. 1.
Figure 6:
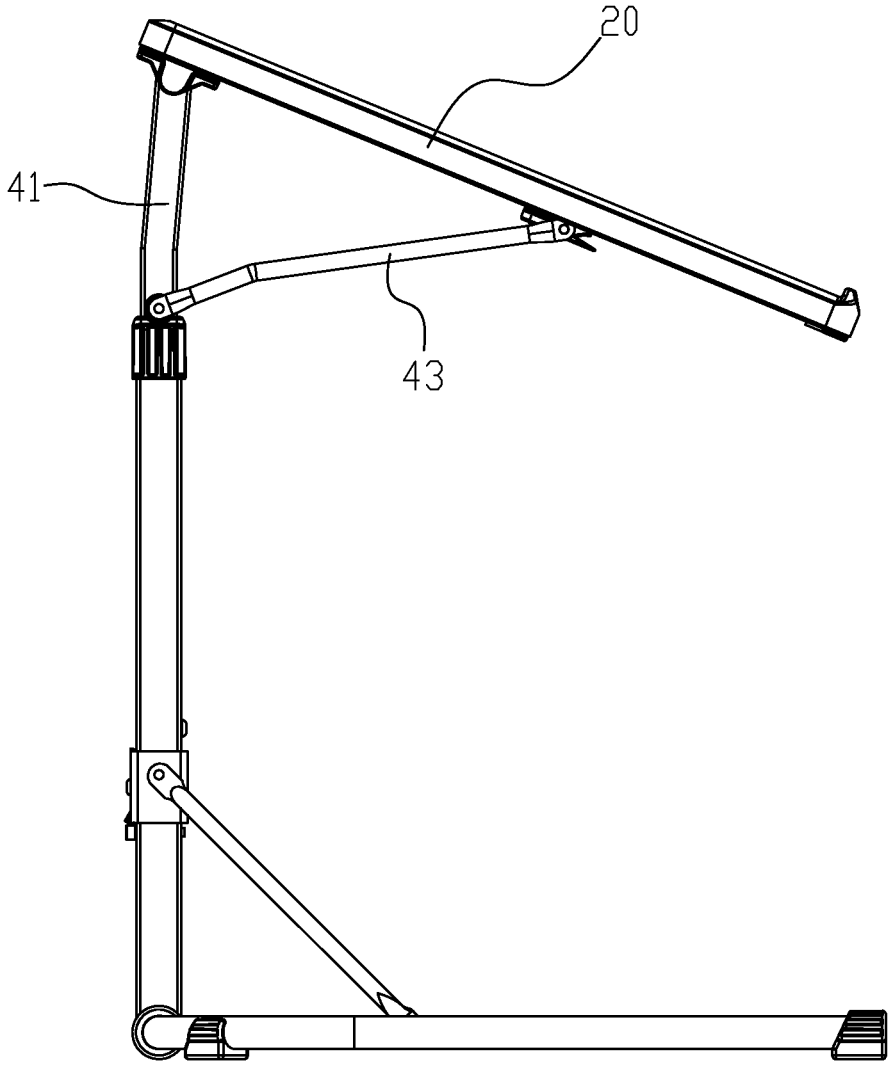
FIG. 6 is a side view of the lifting desk of FIG. 3 when the desk top is folded.

Referring to FIG. 1 and FIG. 2, the control module 46 comprises a slide sleeve 462, a switch 464 and a position pin 466. The slide sleeve 462 is sleeved on the slide bar 45, the central portion of the switch 464 pivotally joins the slide sleeve 462, and the position pin 466 is connected to one end of the switch 464 and is inserted to the position hole 452 to lock the slide sleeve 462. When pressing the other end of the switch 464, the position pin 466 is removed from the position hole 452, so that the slide sleeve 462 is released. The other end of the connecting bar 43 pivotally joins the slide sleeve 462, so that the slide sleeve 462 can drive the other end of the connecting bar 43 to slide at the bottom portion of the desk top 20 along the slide bar 45 in a reciprocating movement. Pressing the switch 464 can remove the position pin 466, so as to move and slide the control module 46 to fold the desk top 20 (as figured in FIG. 6), and the incline angle of the desk top 20 can be adjusted. When the control module 46 moves to the other end of the slide bar 45, the desk top 20 is almost parallel to the inner pipe 41 (as figured in FIG. 8).

Figure 4:
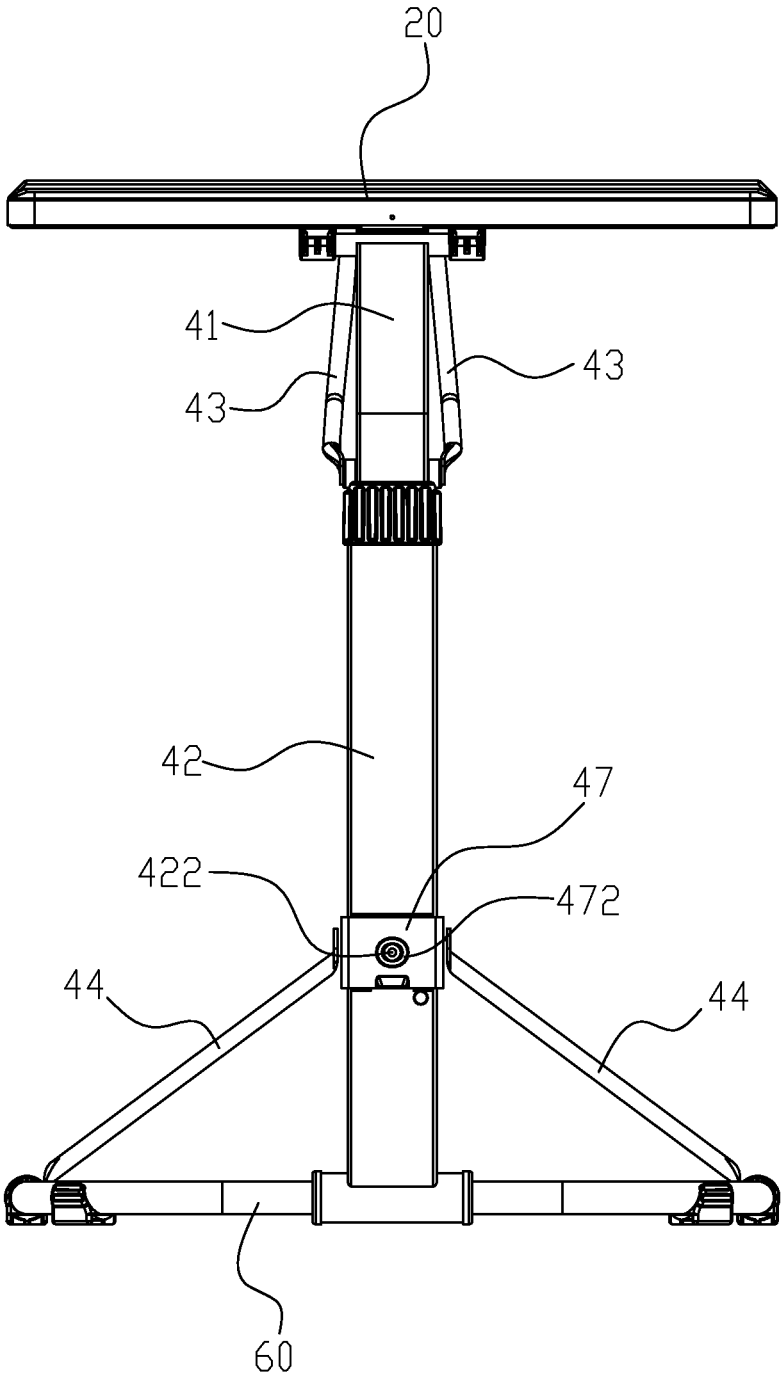
FIG. 4 is a front view of the lifting desk of FIG. 3.
Figure 7:
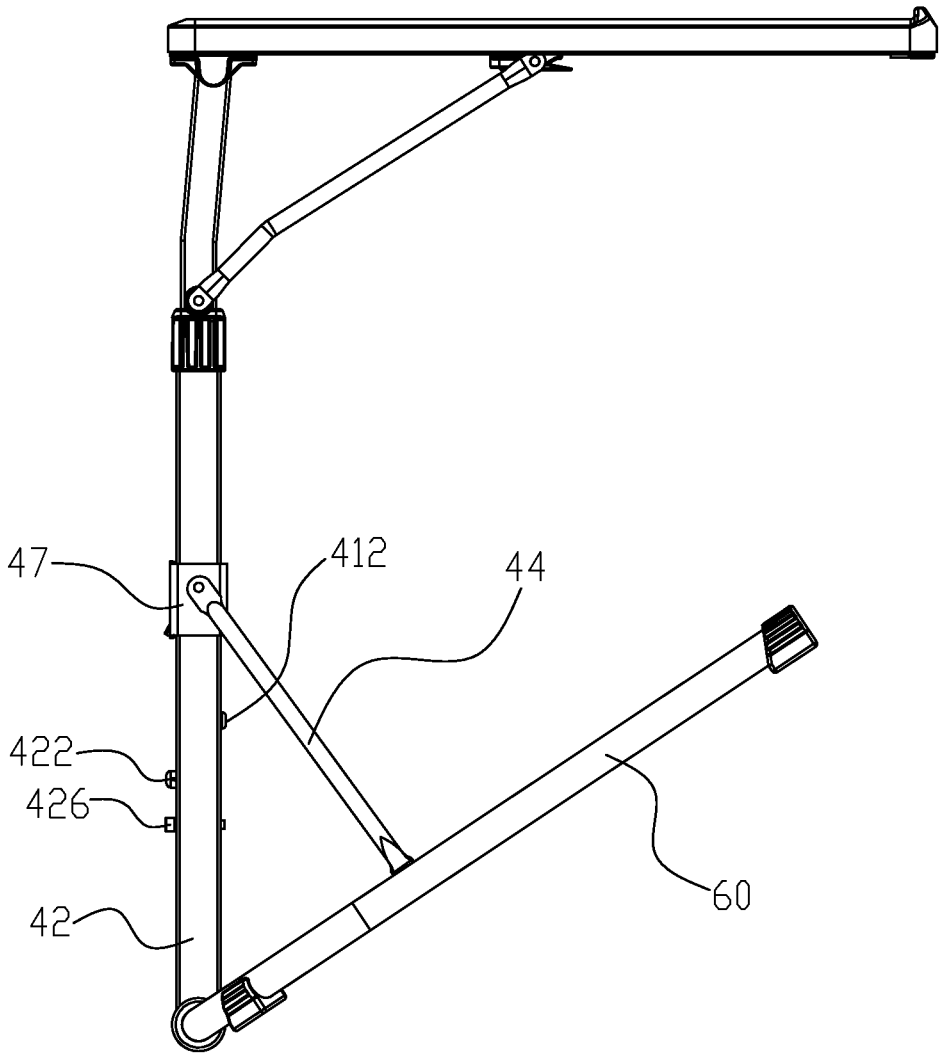
FIG. 7 is a side view of the lifting desk of FIG. 13 when the base is folded.
Figure 8:
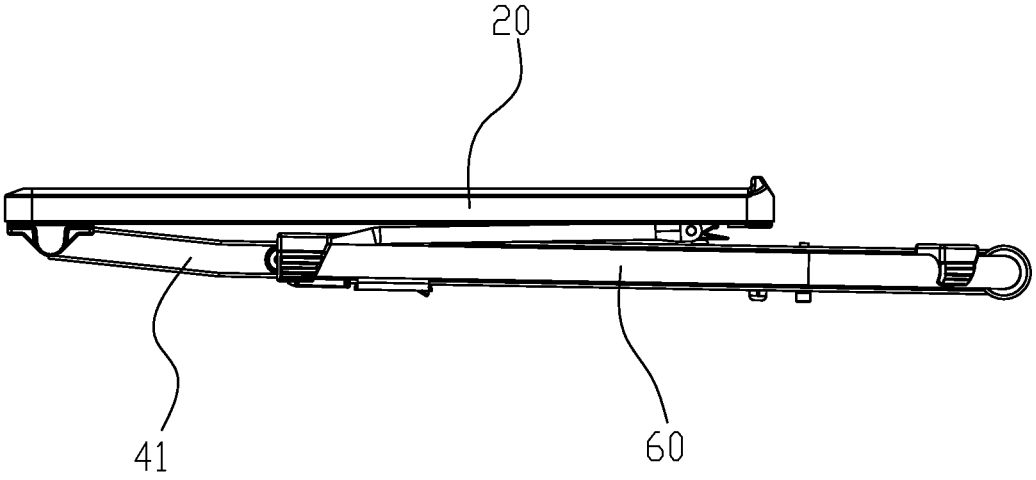
FIG. 8 is a side view of the lifting desk of FIG. 3 after the desk top and the base are fully folded.

The slide set 47 is slidably connected to the outer pipe 42, the slide set 47 is disposed with a through hole 472 (as figured in FIG. 4). The elastic button 422 extends out of the outer pipe 42 and is embedded into the through hole 472 to lock the slide set 47, pressing the elastic button 422 towards the outer pipe 42 can release the lock to the slide set 47. Two drawing bars 44 are respectively disposed at the left and right side of the slide set 47, one end of the drawing bar 44 pivotally joins the base 60, the other end of the drawing bar 44 pivotally joins the slide set 47. pressing the elastic button 422 to the outer pipe 42 can move the slide set 47 vertically, to fold the base 60 (as shown in FIG. 7), when the slide set 47 moves the top portion of the outer pipe 42, the base 60 is almost parallel to the outer pipe (as shown in FIG. 8). When the slide set 47 moves downward and contacts with the position column 426, the base 60 is almost vertical to the outer pipe (as shown in FIG. 4).

Although the present invention has been described with reference to the preferred embodiment thereof for carrying out the patent for invention, it is apparent to those skilled in the art that a variety of modifications and changes may be made without departing from the scope of the patent for invention which is intended to be defined by the appended claims.

The invention claimed is:

1. A lifting desk comprising:

a desk top having a bottom surface, a base, and a support frame, the support frame comprising:

an inner pipe and an outer pipe, the inner pipe having a top end and a bottom end, the inner pipe movably inserted into the outer pipe, the top end of the inner pipe pivotally joining the desk top, the bottom end of the outer pipe pivotally joining the base; and a connecting bar and a drawing bar, one end of the connecting bar pivotally joining a center position of the inner pipe, the other end of the connecting bar connected to the bottom surface and slidable in parallel to the bottom surface, one end of the drawing bar pivotally joining the base, the other end of the drawing bar slidably connected to the outer pipe.

2. The lifting desk according to claim 1, wherein the support frame further comprises a slide bar, the slide bar is connected to the bottom surface, the connecting bar is slidably connected to the slide bar.

3. The lifting desk according to claim 2, wherein the slide bar is disposed with a plurality of position holes along a longitudinal direction, the support frame further comprises a control module, the control module comprises a slide sleeve, a switch having a central portion, the central portion pivotally joining the slide sleeve and a position pin, the connecting bar pivotally joins the slide sleeve, the slide sleeve is sleeved on the slide bar, the position pin is connected to one end of the switch and is adapted to be inserted into a position hole.

4. The lifting desk according to claim 3, wherein the inner pipe is situated near one end of the slide bar.

5. The lifting desk according to claim 1, further comprising two connecting bars pivotally joining the left and right side of the inner pipe.

6. The lifting desk according to claim 1, wherein the support frame further comprises a slide set, the slide set is slidably connected to the outer pipe, the drawing bar pivotally joins the slide set.

7. The lifting desk according to claim 6, wherein the slide set is disposed with a through hole, a button is disposed in the outer pipe, the button is adapted to extend out of the outer pipe and to embed into the through hole.

8. The lifting desk according to claim 7, wherein the base is a U shaped pipe.

9. The lifting desk according to claim 8, wherein when the slide set moves to a top portion of the outer pipe, the base is substantially parallel to the outer pipe; and wherein the outer pipe is disposed with a position column, when the slide set moves downwardly to contact the position column, the base is perpendicular to the outer pipe.

10. The lifting desk according to claim 1, wherein the outer pipe is disposed with a plurality of fixing holes along a longitudinal direction the inner pipe is disposed with a button, the button is adapted to extend out of the inner pipe and to embed into the fixing hole to lock the inner pipe.

* * * * *